United States Patent [19]

Thayer

[11] Patent Number: 4,521,831

[45] Date of Patent: Jun. 4, 1985

[54] PROTECTIVE HELMET WITH DUAL ADJUSTMENT ILLUMINATION MEANS

[76] Inventor: John R. Thayer, Ridge Rd., Fabius, N.Y. 13063

[21] Appl. No.: 571,786

[22] Filed: Jan. 18, 1984

[51] Int. Cl.[3] ..... F21L 15/14; A42B 3/00

[52] U.S. Cl. ..... 362/32; 362/106; 362/191; 362/184; 362/238; 362/427; 362/287; 362/200; 2/422; 2/5

[58] Field of Search ..... 362/105, 106, 184, 238, 362/427, 191, 200, 32, 269, 250; 2/422, 185 R, 5, 209.2, 199, 175, 321, 322

[56] References Cited

U.S. PATENT DOCUMENTS

| | | | |
|---|---|---|---|
| 1,530,402 | 3/1925 | Parker | 362/105 |
| 2,203,028 | 6/1940 | Parrillo | 362/106 |
| 2,461,201 | 2/1949 | Ellis | 2/321 X |
| 2,900,696 | 8/1959 | Bacon | 2/321 |
| 3,134,548 | 5/1964 | Medina et al. | 362/184 |
| 3,273,163 | 9/1966 | Andrews | 2/422 |
| 3,302,018 | 1/1967 | Harding | 362/106 |
| 3,577,561 | 5/1971 | Ota-Shi | 2/422 |
| 4,156,942 | 6/1979 | Isfeld | 362/106 X |
| 4,196,966 | 4/1980 | Malis | 362/32 X |
| 4,298,913 | 11/1981 | Lozar | 362/105 X |
| 4,324,158 | 4/1982 | LeRoy | 362/119 X |
| 4,360,930 | 11/1982 | Blanchard | 2/209.2 |

*Primary Examiner*—Stephen C. Bentley
*Assistant Examiner*—John S. Maples
*Attorney, Agent, or Firm*—Bruns and Wall

[57] ABSTRACT

A pair of lamps are mounted on either side of a protective helmet on indexing tables that permit each lamp to be independently directed at a different target. Each lamp table is slidably received within a base section so that the lamp can be easily removed from the helmet. A utility band passes between the two base sections and is held therebetween by gripping bars mounted in each base section. The band is adapted so that articles can be carried thereupon.

9 Claims, 8 Drawing Figures

PROTECTIVE HELMET WITH DUAL ADJUSTMENT ILLUMINATION MEANS

BACKGROUND OF THE INVENTION

This invention relates to a protective helmet and, in particular, safety apparatus for mounting upon such a helmet.

In many hazardous occupations, the people involved are required to wear protective helmets designed to prevent or lessen the danger of head injuries caused by falling objects or the like. One such occupation is that of a fire fighter or fireman who must on occasion enter smoke-filled buildings to either battle a fire or conduct rescue operations. It is essential in this type of environment that the fire fighter have some type of illumination to enable him to see and be seen in this low-visibility environment. Although helmets, such as those worn by miners, have been equipped for quite some time with lamps, these lamps are invaribly mounted upon the front of the helmet with the beam being directed forwardly. To change the beam direction, the wearer must move his head towards the target area. This, of course, places a severe limitation on the wearer in that the position of the head dictates where the eyes will focus thereby depriving the eyes of their mobility and normal quick response.

In the case of a fire fighter who is forced to find his way through a smoke-filled building or the like, it may often times be important that he have illumination in more than one direction. For example, he may wish to clearly see the floor area immediately ahead of him in order to avoid all types of hazards while at the same time being able to search beyond in a forwardly direction. Similarly, he may want to be able to scan a light in the forward direction while still providing rearwardly-directed illumination for people who are following him. Clearly, a single lamp mounted on the front of the helmet cannot provide these valuable safety-related functions.

Beyond providing a convenient place for mounting illumination equipment, the protective helmet also affords an ideal place to mount, store and/or carry many different types of articles. Firemen, for example, generally carry a number of wedges on their person which are used to hold doors open. Often times, if not wedged, a door will be forced shut thus trapping the fireman in a burning or smoke-filled building. It is therefore important that these wedges be carried in a readily available place so that they can be put into operation quickly when needed. The protective helmet has been found to be an ideal place for such storage. However, securing the wedges to the helmet has long been a problem in the art.

SUMMARY OF THE INVENTION

It is therefore an object of the present invention to improve protective head gear and, in particular, head gear worn by fire fighters.

A further object of the present invention is to provide a protective helmet having an illumination system that is capable of projecting multiple light beams in different directions.

Yet another object of the present invention is to provide a multi-purpose utility package that can be easily and securely mounted upon the outer shell of an existing protective helmet.

A still further object of the present invention is to provide for the safety of those having to work in darkened, hazardous areas.

These and other objects of the present invention are attained by means of a protective helmet having an illumination system containing at least one swivel-mounted lamp that can be quickly and easily adjusted to direct the light beam at any desired target. In the main embodiment of the present invention, a pair of lamps are mounted upon base members positioned on opposite sides of the helmet. Each of the lamps is capable of being turned in a vertical plane through 360 degrees of arc. A utility band is passed about the rear of the helmet between the two base members and is used as a storage medium for various work-associated articles.

BRIEF DESCRIPTION OF THE DRAWINGS

For a better understanding of these and other objects of the present invention, reference is had to the following detailed description of the invention which is to be read in conjunction with the accompanying drawings, wherein.

DESCRIPTION OF THE INVENTION

Figure 1:
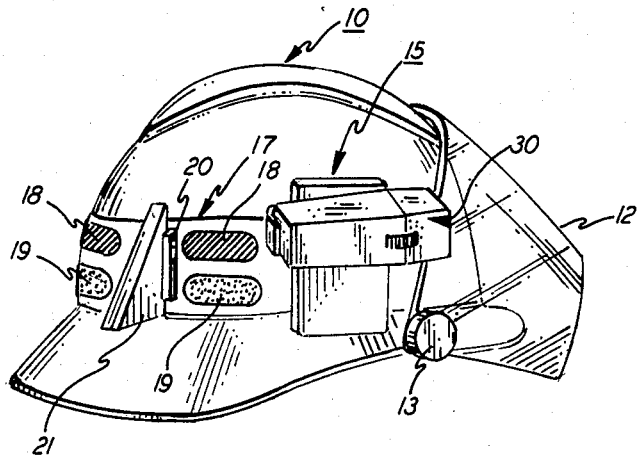
FIG. 1 is a perspective view of a protective helmet embodying the teachings of the present invention.
Figure 2:
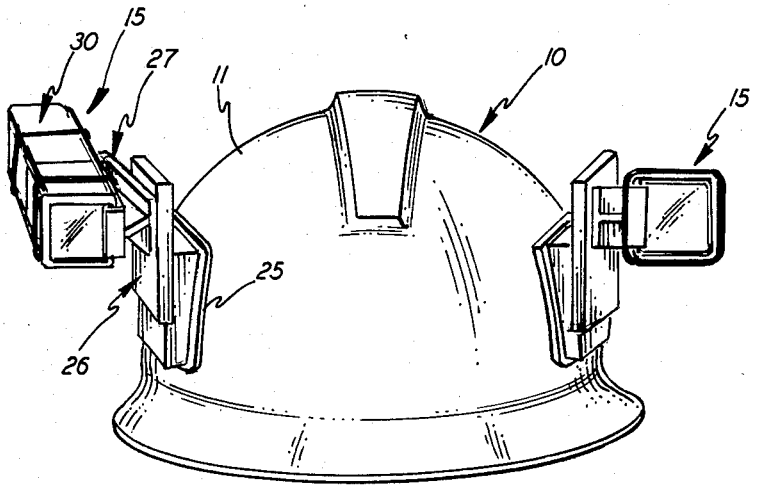
FIG. 2 is a rear view of the helmet shown in FIG. 1 further illustrating a pair of lamp assemblies arranged to direct two independent beams of light in different directions.
Figure 3:
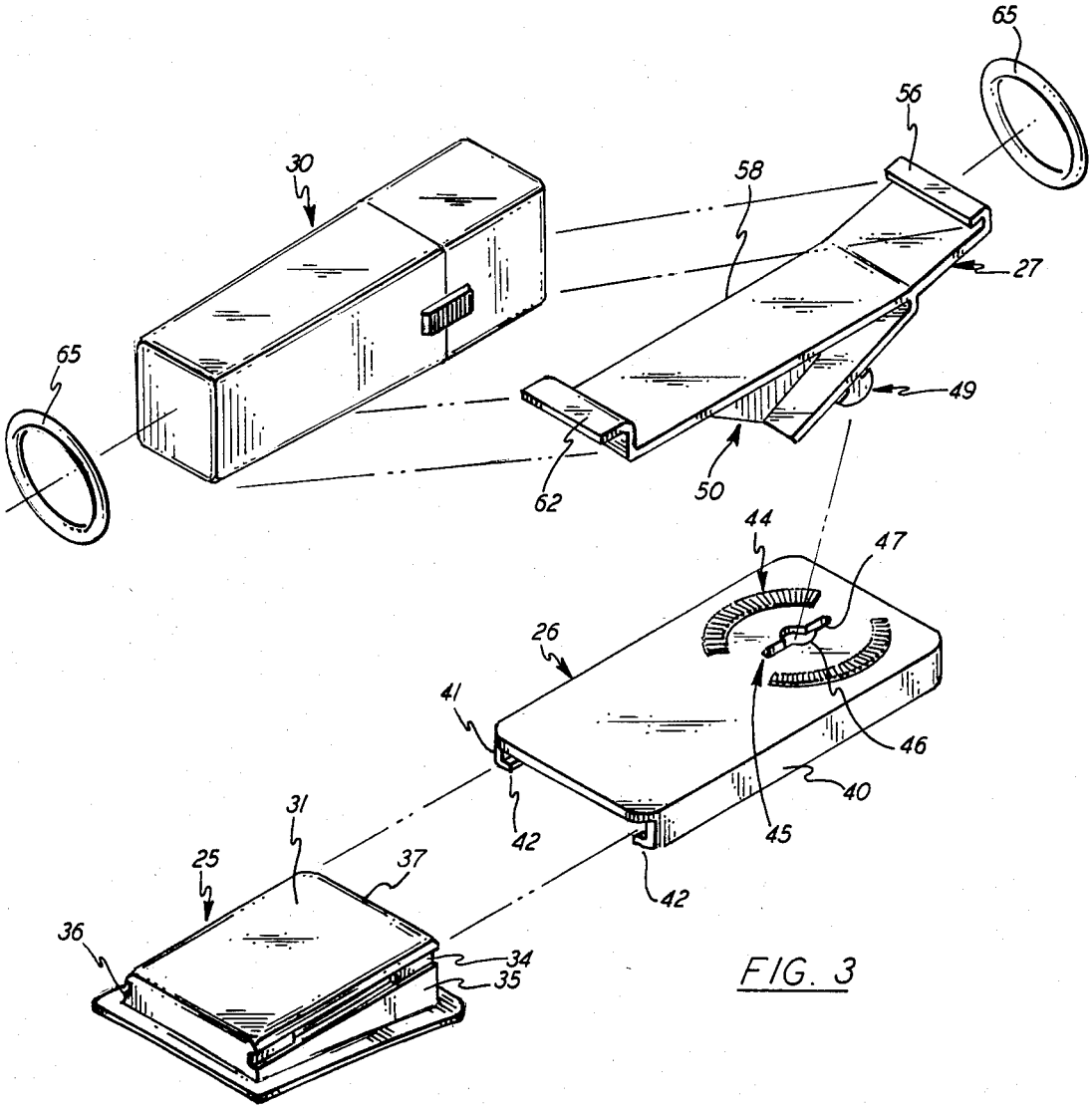
FIG. 3 is an exploded view in perspective showing the elements making up each of the lamp assemblies.
Figure 5:
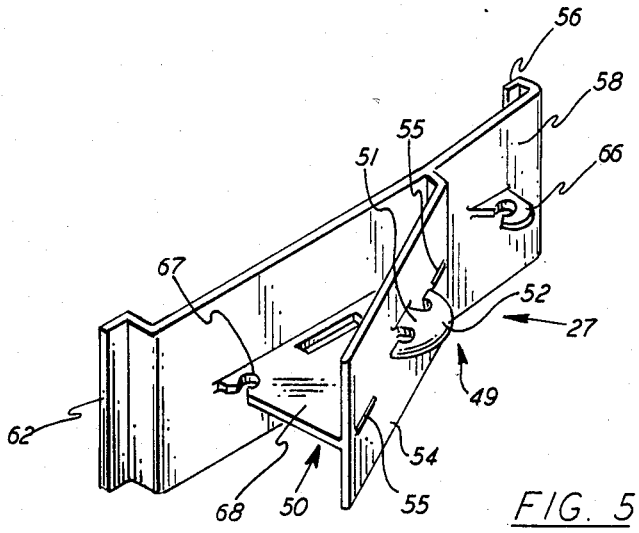
FIG. 5 is a perspective view of the lamp-support element shown in FIG. 3 illustrating further features thereof.

Turning now to the drawings wherein like parts are identified by like numbers, there is shown a protective helmet, generally referenced 10 of the type typically worn by firemen when forced to enter a hazardous area such as a burning building or the like. The helmet is of generally well-known construction and includes an outer one-piece shell 11 made of high-impact resistant plastic that is capable of sustaining a heavy blow without breaking. As illustrated in FIGS. 1 and 2, a retractable transparent visor 12 is rotatably supported in the front of the helmet by means of pivots, one of which is shown at 13, so that the visor can be snapped down to protect the face of the wearer. A pair of lamp assemblies 15—15 are secured to both sides of the helmet shell to provide illumination that can be selectively directed by the wearer at two different targets. A utility band 17 is passed around the back of the helmet with the ends of the band being adjustably gripped within each of the lamp assemblies. The band is formed of a plyable plastic material, such as nylon, and is adapted to hold various duty-related articles thereon. In this particular embodiment, the band includes a series of reflectors 18—18 and a companion series of phosphorescent strips 19—19 sewn therein. In addition, U-shaped spring clamps 20 are molded into the band at spaced apart intervals. The clamps are adapted to slidably receive wedges, such as wedge 21, therein. When needed, the wedges can be quickly snapped out of the clamps and placed immediately into service to hold doors open or to close off water sprinklers.

With further reference to FIGS. 3–7, each of the lamps assemblies is made up of a number of different elements that can be easily molded using well-known molding techniques. These elements include a base member 25, a carriage 26 and a lamp support member 27. A battery-operated lamp 30 of rectangular form is also provided in this particular embodiment which is secured to the support member 27. Lamps of this nature can be commercially purchased from a large number of suppliers and are generally discarded when the battery becomes exhausted and replaced with a new unit. In any event, the support member can be specifically contoured to complement the outer geometry of the lamp.

The base section of the lamp assembly includes a contoured flange 32 which forms the bottom rim of the base section and which is shaped to complement the outer contour of the helmet in order to form a continuous joint therebetween. The inside face 33 (FIG. 7) of the base rim is provided with a contact cement capable of forming a high-strength bond between the rim and the shell of the helmet to securely affix the base thereto. Prior to mounting, the cement coating is covered with a tear strip that protects the adhesive. The flange, which is molded of a plastic material, has sufficient flexibility to allow it to be seated in conforming contact against the arcuate-shaped shell of the helmet. The outer face (FIG. 3) of the base section is planar in form and is slightly canted in regard to the flange so that the face is generally disposed in a vertical plane when the base is mounted upon the helmet. A pair of parallel grooves 34—34 are vertically extended in opposite side walls 35 and 36 of the base section and coact to form a slide mechanism for receiving the carriage 26 therein. The vertical travel of the carriage is arrested by the hub 48 of the carriage abutting against the top surface 37 of the receiving base.

Figure 6:
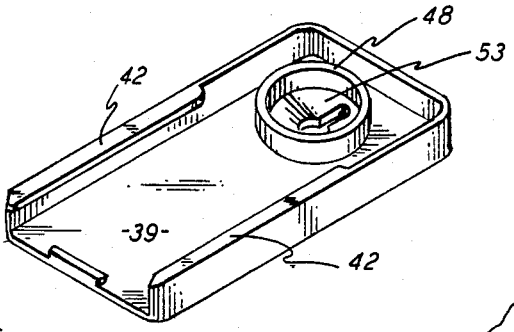
FIG. 6 is a perspective view of a carriage shown in FIG. 3 also illustrating further features thereof.

The carriage 26 contains a flat table 39 from which depends a pair of side walls 40 and 41. A pair of rails 42—42 are inwardly disposed from the side walls. The rails are slidably received in assembly within the groove formed in the base section 25 so that the carriage can be mounted in vertical alignment within the base as shown in FIGS. 1 and 2. A circular ratchet 44 is molded in the top surface 43 of the table and contains two semi-circular segments each of which has upraised, equally-spaced teeth. A key slot 45 is centered inside the ratchet circle and includes a central hole 46 and an elongated passage 47. An annular hug 48, as shown in FIG. 6, is contained on the back face of the carriage table which surround the key slot to provide added strength in this critical area.

The lamp-support member 27 is rotatably mounted upon the carriage table using a key 49 that depends downwardly from bracket 50. The key includes a shank 50 and an elongated head 51 which are capable of passing into the key slot 45 formed in the carriage table. The support member 27 is locked to the table by inserting the key into the key slot and turning the support member to bring the head 52 of the key beneath the bottom surface of the table. As best illustrated in FIG. 6, the surface 53 of the table within hub 48 is inclined so that as the support member is turned, the head of the key is brought into friction contact with the surface 53 contained within the hub. This, in turn, draws the bottom surface 54 of bracket 50 into sliding contact against the top surface 43 of the carriage table. A pair of opposed pawls 55—55 project outwardly from the bottom wall 54 of the bracket and are adapted to operatively engage the teeth formed within the circular ratchet carried upon the top surface of the table. The lamp support can thus be selectively indexed to a desired position on the carriage table by simply rotating the support member upon the carriage within the operating range of the ratchet. The key arrangement permits the support to be rotated through a full 360 degrees upon the table.

Figure 4:
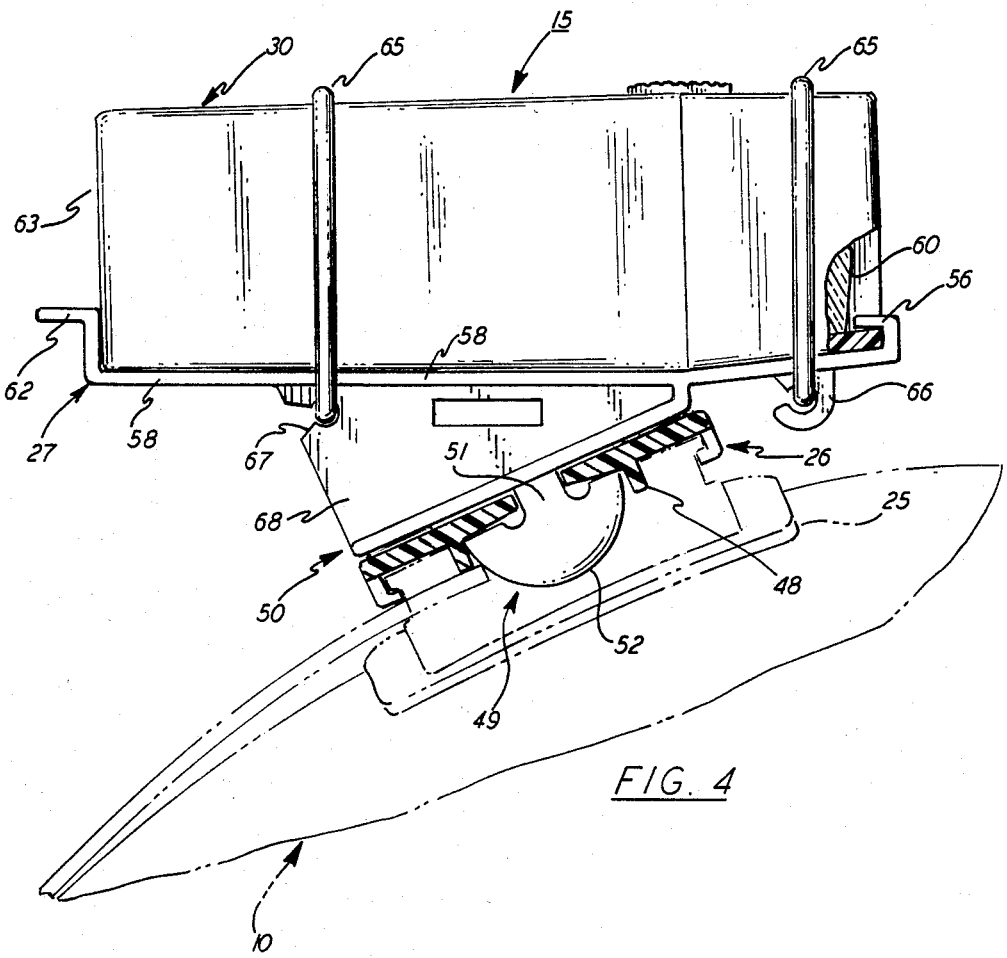
FIG. 4 is an enlarged side elevation in partial section showing one of the lamp assemblies.

A platform 58 is secured to the top of the bracket 50 of the support member 27 which conforms to the shape of the lamp 30. The platform includes a raised, inwardly-turned lip 56 capable of being brought close to the lower margin of the lamp lens 60 (FIG. 4). A raised flange 62 is carried upon the rear edge of the platform which, in assembly, passed upwardly along the back wall 63 of the lamp. In practice, the lamp is seated upon the platform and held in place by means of two elastic O-rings 65—65. One ring encompasses the front of the lamp and is deformably passed into a hook-like appendage 66 mounted beneath the platform. The second ring encircles the rear of the lamp and is also deformably passed into a slot 67 formed in the riser 68 of bracket 50. The platform is formed of a clear plastic material that acts as a light pipe to transmit a portion of the light energy emitted through the lens to the rearwardly-mounted wall 62. To someone viewing the lamp from behind, the wall will appear as a relatively bright surface that can be clearly seen when visibility is poor to help identify the wearer's position.

As should now be evident from the disclosure above, each of the two lamps are rotatably supported upon the helmet so that each may be independently turned in a vertical plane through 360 degrees of rotation. Through use of the ratchet-and-pawl arrangement each lamp can be brought to a desired position within this field of rotation so as to direct a beam at a desired target region. To redirect either beam, the user simply has to reach up and turn the lamp as required. The lamp-support platform can be conveniently shaped to receive a desired commercially-available lamp and the lamp can be quickly changed when no longer serviceable. Through use of the carriage arrangement, the lamps can also be easily removed from the helmet when their use is not required or when hand-held operation of the lamp is desired. This, in turn, protects the lamps fron unnecessary risk and thus will extend their usable life. All parts of the present lamp-support system are molded from plastic materials and therefore can be mass-produced accurately and inexpensively.

Figure 8:
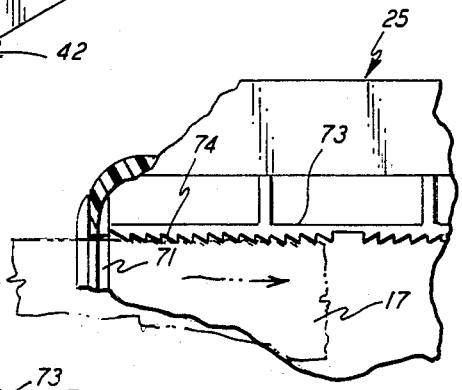
FIG. 8 is an enlarged bottom view in partial section showing the base illustrated in FIG. 7 with the utility band inserted therein.
Figure 7:
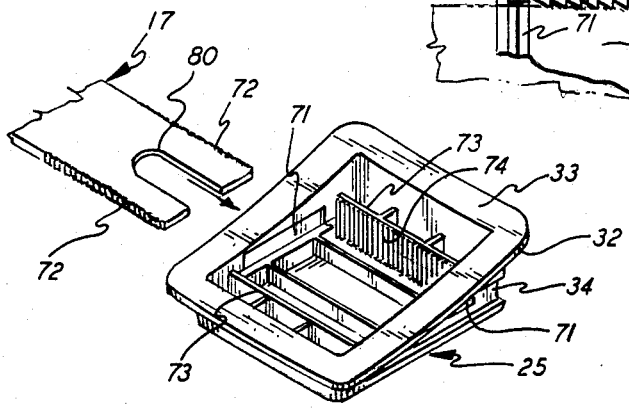
FIG. 7 is a perspective view of the base element shown in FIG. 3 illustrating a gripping means for securing a utility band within the base.

Turning now to FIGS. 7 and 8, there is shown a utility band 17 that passes above the back of the helmet. The ends of the band are passed into the base section of each lamp assembly through slots 71—71. The band, as noted above, is formed of nylon and has seriated edges 72—72 formed at either end thereof. Gripping bars 73—73 are mounted inside of each base section adjacent to the slots 71—71. Each bar contains a series of teeth 74 that are adapted to engage the serrated edges of the band as the band is inserted into the base. A U-shaped groove 80 is passed into each end of the band to provide sufficient flexibility thereto so that the coacting teeth can be forced one over the other as the band passes into the base section. As best seen in FIG. 8, the teeth adjacent to the slotted opening are slanted inwardly to facilitate insertion of the band while at the same time providing sufficient gripping action to prevent the band from pulling out of the base section under normal operating conditions. Once the lamp assembly has been secured to the helmet shell, the utility band can be quickly and easily installed between the base sections to provide a convenient and easily-accessible means for mounting, storing and carrying job-related articles and equipment.

While this invention has been disclosed with specific reference to the details as set forth above, it is not intended to be limited to this specific structure and the invention is intended to cover any modifications or changes that may come within the scope of the present claims.

We claim:

1. In a protective helmet having two sidewalls and an adjustable visor connected to the front thereof for shielding the wearer's face, illuminating apparatus for directing independent beams of light at selective targets at either the front or the rear of the helmet that includes a base member projected outwardly from each sidewall of the helmet, each base member having a guideway formed therein, a removable carriage having rail means slidably received in the guideway of each base member for detachably securing the carriage in said base, a lamp support pivotally mounted in each carriage for rotating a lamp mounted therein within a vertical plane adjacent the base, and an indexing means acting between each carriage and the associated lamp support for releasably positioning the support within said plane whereby each lamp can be independently directed toward separate targets to either the front or the rear of the helmet without interfering with the adjustable visor.

2. The protective helmet of claim 1 wherein the indexing means includes a circular rachet means and a pawl means resiliently contained in the said rachet means.

3. The protective helmet of claim 1 that further includes a utility band extending around the back of the helmet between the base members and means to detachably secure an end of the band in each base.

4. The protective helmet of claim 1 that further includes a light pipe associated with each lamp support for transmitting a portion of the light emitted by the lamp to the rear of the support.

5. Apparatus for use in a protective helmet having opposing sidewalls that includes an illuminating unit mounted on each of the sidewalls of said helmet;

each unit having a base member secured to an adjacent sidewall of said helmet, a removable carriage slidably received in each base member, a lamp support means pivotally contained in each carriage for rotating a lamp mounted therein within a vertical plane adjacent to the sidewall of the helmet, and an indexing means acting between each carriage and the connected support means for releasably holding the support means at a desired location within said plane whereby the lamp supported in each unit can be independently directed at a different target, each base member having two side walls and a front and rear wall and further having a slotted opening formed in each of said side walls for insertably receiving therein a utility band having top and bottom edges, said front and rear wall each having a gripper bar attached thereto having teeth for engaging the top and bottom edges of the band, and said band having serrations formed in the top and bottom edges thereof for coacting with the teeth of the gripper bars to secure the ends of the band within the base members.

6. The apparatus of claim 5 wherein said band means includes a series of spring biased clips for detachably supporting wedging blocks upon the said band.

7. The apparatus of claim 5 that further includes light reflectors secured to the band.

8. The apparatus of claim 5 that further includes a light pipe associated with each lamp support means for transmitting a portion of the light emitted by the lamp to the face of the support means whereby light is visable to both the front and rear of said support means.

9. The apparatus of claim 5 that further includes adhesive means contained in each of the said base members for securing the base member to the helmet.

* * * * *